US011492738B2

(12) United States Patent
Moore, III

(10) Patent No.: US 11,492,738 B2
(45) **Date of Patent: *Nov. 8, 2022**

(54) TEXTILE CLAMPING DEVICE FOR A SEWING MACHINE

(71) Applicant: EFP, Inc., Randleman, NC (US)

(72) Inventor: Edgar Franklin Moore, III, Randleman, NC (US)

(73) Assignee: EFP, Inc., Randleman, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/363,850

(22) Filed: Jun. 30, 2021

(65) Prior Publication Data

US 2021/0324559 A1 Oct. 21, 2021

Related U.S. Application Data

(63) Continuation of application No. 17/090,373, filed on Nov. 5, 2020, now Pat. No. 11,060,223.

(60) Provisional application No. 62/931,767, filed on Nov. 6, 2019.

(51) Int. Cl.
*D05C 9/04* (2006.01)

(52) U.S. Cl.
CPC ..... *D05C 9/04* (2013.01)

(58) Field of Classification Search
CPC ... D05C 9/00; D05C 9/02; D05C 9/04; D05C 9/06; D05C 9/08; D05C 9/10; D05C 9/12; D05C 9/14; D05C 9/16
See application file for complete search history.

(56) References Cited

U.S. PATENT DOCUMENTS

| | | | | |
|---|---|---|---|---|
| 3,664,288 | A * | 5/1972 | Weidlin Von Boden | D05C 9/04 112/103 |
| 6,354,234 | B2 * | 3/2002 | Wakasugi | D05C 9/04 112/470.14 |
| 6,382,116 | B2 * | 5/2002 | Wakasugi | D05C 9/04 112/103 |
| 6,463,867 | B2 * | 10/2002 | Kato | D05C 9/04 112/470.14 |
| 7,377,222 | B1 * | 5/2008 | Moore, III | D05B 39/00 |
| 11,060,223 | B2 * | 7/2021 | Moore, III | D05C 9/04 |
| 2001/0037755 | A1 * | 11/2001 | Wakasugi | D05C 9/04 112/470.14 |
| 2010/0313804 | A1 * | 12/2010 | Konig | D05C 9/04 112/103 |

(Continued)

*Primary Examiner* — Danny Worrell
(74) *Attorney, Agent, or Firm* — NK Patent Law

(57) ABSTRACT

Textile machine clamping device includes a first arm comprising a moveable blade that moves inwardly relative to a compression surface and a second arm comprising a moveable blade that moves inwardly relative to a compression surface. Each of the moveable blades defines a resilient portion that compresses against an article of clothing positioned between the respective resilient portion and compression surface of each of the first arm and the second arm. The direction of travel of each of the first arm and the second arm as each of the arms is being translated into a compressed state is towards each other. In operation, the user may engage one portion of clothing between the resilient portion and compression surface of the first arm, pull taut on the article of clothing and then engage a second portion of clothing between the resilient portion and compression surface of the second arm.

6 Claims, 3 Drawing Sheets

(56) References Cited

U.S. PATENT DOCUMENTS

| | | | | |
|---|---|---|---|---|
| 2011/0315059 | A1* | 12/2011 | Lee | D05B 39/00 112/103 |
| 2012/0060732 | A1* | 3/2012 | Viltrakis | D05C 9/04 112/103 |
| 2015/0000575 | A1* | 1/2015 | Kawaguchi | D05C 9/04 112/103 |
| 2017/0342619 | A1* | 11/2017 | Coombes | D05B 29/00 |
| 2018/0320300 | A1* | 11/2018 | Kawaguchi | D05B 39/00 |

* cited by examiner

TEXTILE CLAMPING DEVICE FOR A SEWING MACHINE

CROSS-REFERENCE TO RELATED APPLICATIONS

This application is a continuation application of U.S. patent application Ser. No. 17/090,373, filed on Nov. 5, 2020, which claims priority to U.S. Provisional Patent Application No. 62/931,767 filed on Nov. 6, 2019, the entire contents of which are incorporated by reference herein.

TECHNICAL FIELD

The invention herein pertains to clamping devices for sewing machines in general, and particularly to a clamping device for use on a typical embroidering machine.

BACKGROUND

During the process of stitching or embroidering on fabrics and other materials, such materials need to be held or contained in a taut, fixed configuration to ensure the embroidery pattern is correctly applied. Wrinkles, gaps, or loose material can create an unacceptable stitching or embroidering pattern and the embroidered item such as a shirt, cap, uniform, or the like will have to be reprocessed again or discarded.

Prior art hand stitching and embroidery techniques often utilized "hoops" formed from wood, metal or plastic that were used to tighten a section of, for example, fabric over a shirt pocket. Once the fabric was "hooped", the embroidery process could proceed with fairly good results. With the advent of high-speed sewing machines, more accurate "hooping" devices were required, and different devices were built for assisting in the embroidery process. However, such hooping devices were awkward in that they were often difficult to load, adjust and unload after the stitching/embroidering process was complete.

Thus in view of the known problems and disadvantages of prior hooping or clamping devices the present invention was conceived and one of its objectives is to provide a simple yet efficient material clamping device for attachment on a conventional sewing or embroidering machine.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

According to one or more embodiments, a textile machine clamping device includes a first arm comprising a moveable blade that moves inwardly relative to a first compression surface and a second arm comprising a moveable blade that moves inwardly relative to a second compression surface. Each of the moveable blades defines a resilient portion that compresses against an article of clothing positioned between the respective resilient portion and compression surface of each of the first arm and the second arm. The direction of travel of each of the first arm and the second arm as each of the arms is being translated into a compressed state is towards each other.

According to one or more embodiments, the resilient portion is carried within a channel defined in the respective arm, the arm being positioned higher than the compression surface and the resilient portion being positioned in line with the compression surface.

According to one or more embodiments, each arm is movable along a longitudinal direction of an embroidering or sewing machine.

According to one or more embodiments, each arm moves a same distance from a center line as the other arm.

According to one or more embodiments, each arm moves the same distance in response to respective brackets extending from a slot to each of the arms.

According to one or more embodiments, the resilient portion is moved into engagement with the compression surface by manipulation of respective first and second handles engaged with first and second arms, wherein the handles impart a pivoting, inward movement to the arms.

According to one or more embodiments, the arms slide along a rail, the rail defining graduation marks to determine distance for horizontal sewing field size.

According to one or more embodiments, in operation, the resilient portions deflect outwardly and downwardly when in contact with respective first and second compression surfaces, thus imparting outwardly and downwardly forces to the article of clothing.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTION OF THE EMBODIMENTS

Figure 1:
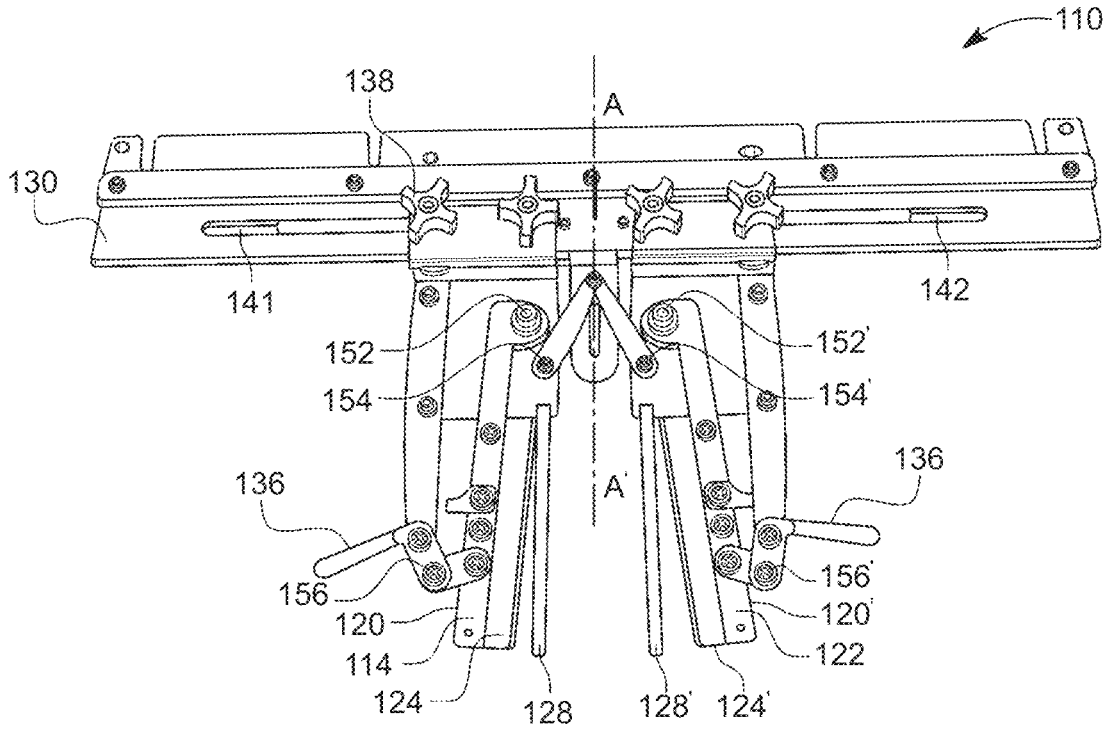
FIG. 1 illustrates a schematic representation of a clamping device for use with a typical embroidering machine, according to one or more embodiments of the presently disclosed subject matter.

The following description and figures are illustrative and are not to be construed as limiting. Numerous specific details are described to provide a thorough understanding of the disclosure. In certain instances, however, well-known, or conventional details are not described in order to avoid obscuring the description. Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. It will be appreciated that same thing can be said in more than one way.

Alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods, and their related results according to the embodiments of the present disclosure are given below. Note that titles or subtitles may be used in the examples for convenience of a reader, which in no way should limit the scope of the disclosure.

As will be described in greater detail below with reference to the figures, the subject matter described herein provides for methods, devices, and systems for improved ways of embroidering. A textile machine clamping device according to one or more embodiments of the presently disclosed subject matter is illustrated in FIGS. 1 through 5.

FIGS. 1 through 6 illustrate various aspects of a textile machine clamping device 110 (alternately referred to herein as "clamping device" or just "device"), according to one or more embodiments of the presently disclosed subject matter. In various embodiments, clamping device 110 includes a first arm 120 that includes a moveable blade 114 that moves inwardly relative to compression surface 128. Moveable blade 114 defines a resilient portion 124 that compresses against an article of clothing 101 that is positioned between resilient portion 124 and compression surface 128 of arm 120. Clamping device 110 further includes a second arm 120' that includes a moveable blade 122 that moves inwardly relative to compression surface 128'. First arm 120 is pivotable about arm pivoting point 152 while arm 120' is pivotable about arm pivoting point 152'. Moveable blade 122 defines a resilient portion 124' that compresses against an article of clothing 101 that is positioned between the respective resilient portion 124' and compression surface 128' of arm 120'.

In various embodiments, clamping device 110 is configured for being attached to a sewing machine or a frame member thereof. In one embodiment, the sewing machine that clamping device 110 attaches to a typical embroidery machine having a sewing head with a needle for embroidering, stitching or sewing materials such as caps, jackets, shirts and the like. The sewing machine may include a conventional control panel for allowing an operator to program and/or direct X-Y movements of the frame member of the sewing machine and a sewing head of the sewing machine as required during the stitching or embroidering process.

Clamping device 110 is according configured for being able to be fixed to the frame member of the sewing machine, for example, by bolts or similar other securing mechanisms. In one embodiment, bolts can pass through apertures provided on mounting plate 130 (see FIG. 1) to attach clamping device 110 to the frame member of a sewing machine. Mounting plate 130 further includes slots 141, 142 that allow arms 120, 120' to slide there along for adjusting the space between arms 120 and 120' as required, depending on the size of the selected item and the pattern to be stitched or embroidered thereon. Accordingly, in at least one embodiment, arms 120, 120' can slide to the left direction and the right direction on FIG. 1 along a rail where the rail optionally defines graduation marks to determine distance. Various components of clamping device 110 can be formed of steel and other suitable materials.

Figure 2:
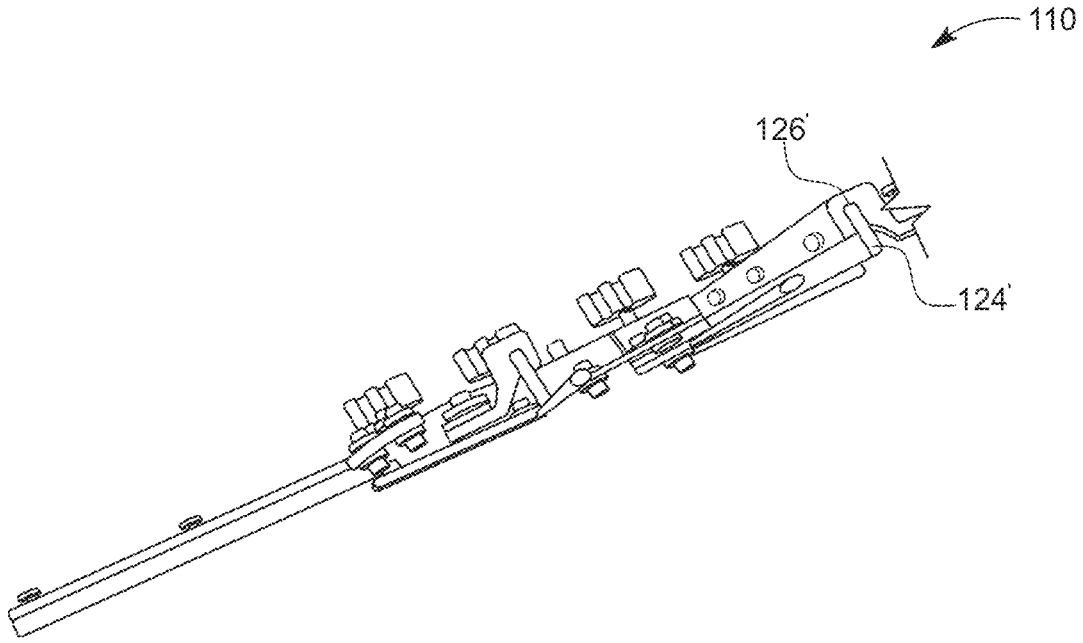
FIG. 2 illustrates a side elevational view of the clamping device of FIG. 1, according to one or more embodiments of the presently disclosed subject matter.
Figure 3:
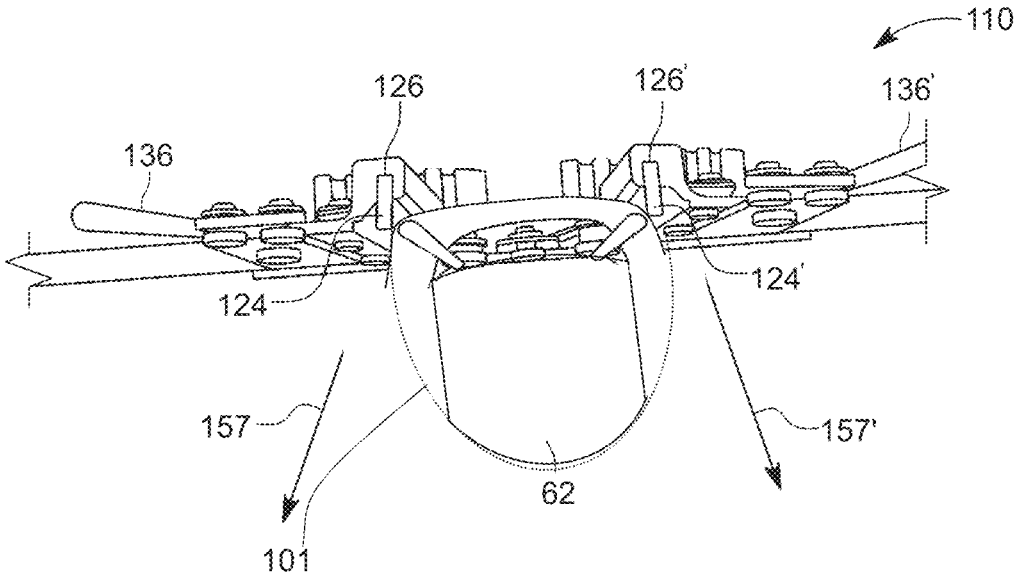
FIG. 3 illustrates a front perspective view of the clamping device of FIG. 1 with a fabric tightly engaged in the arms of the clamping device, according to one or more embodiments of the presently disclosed subject matter.

As illustrated in FIG. 3, resilient portion 124 can be carried within a channel 126 (also see FIG. 2) defined in arm 120 while resilient portion 124' is carried within a channel 126' defined in arm 120'(see FIG. 2, for example). This provision may allow for selective replacement of resilient portions 124, 124' either due to wear, or if the user desires a different durometer reading or different material construction, or for a shorter, longer, thinner, wider, or other desired construction. In at least one embodiment, arm 120 is positioned higher than resilient portion 124 while arm 120' is positioned higher than resilient portion 124'. Resilient portion 124 can be positioned at substantially the same level as compression surface 128 while resilient portion 124' can be positioned at substantially the same level as compression surface 128'.

Accordingly, in operation, the resilient portions 124, 124' can be moved into engagement with the compression surface by manipulation of respective first and second handles 136, 136' engaged with respective first and second arms 120, 120', wherein the handles impart a pivoting, inward movement to the arms. This is illustrated with reference to FIG. 3. The user may engage one portion of clothing 101 between the resilient portion and compression surface of arm 120, pull taut on the article of clothing 101 and then engage a second portion of clothing between the resilient portion and compression surface of arm 120'. In this manner, it pulls the clothing taut without the use of overly hard surfaces that can damage or mar the clothing, and the resiliency of the arms provides some dampening forces to vibrations imparted by the embroidery, sewing, or other textile working machine. In operation, the resilient portions deflect outwardly and downwardly when in contact with respective first and second compression surfaces, thus imparting outwardly and downwardly forces to the article of clothing as illustrated with arrows 157, 157' in FIG. 3. Once the sewing or embroidering is completed, handles 136, 136' can be unlocked by manipulating the handles to the unlocked position and clothing 101 is removed and replaced with the next clothing or item to be embroidered.

In some embodiments, a cylinder arm 62 is provided housing components of the embroidery machine. In at least one embodiment, the disposition of cylinder arm 62 is such that it extends outwardly in a direction parallel to the direction in which arms 120, 120' extend; in other words, in FIG. 3, cylinder arm 62 extends in a direction that is substantially perpendicular to a plane of the page illustrating FIG. 3. According to at least one embodiment, the article of clothing 101 is laid on top of cylinder arm 62 following which the user may engage one portion of clothing 101 between the resilient portion and compression surface of arm 120, pull taut on the article of clothing 101 and then engage a second portion of clothing between the resilient portion and compression surface of arm 120'. In various embodiments, cylinder arm 62 can take various cross-sectional shapes including a circle, an oval, a square, a cylinder or combinations thereof. In one embodiment, cylinder arm 62 is permanently attached to the embroidering or sewing machine. In one embodiment, cylinder arm 62 is removably attached to the embroidering or sewing machine by means of a bolting or screwing arrangement, for example. In one embodiment, cylinder arm 62 is permanently or removably attached to clamping device 110.

In various embodiments, arm 120 and arm 120' are configured for being moved along a longitudinal direction of an embroidering or sewing machine, which, in one embodiment, can be of the high-speed type, as is well-understood in the art. In at least one embodiment, clamping device 110 is configured such that the direction of travel of each of arm 120 and arm 120' towards each other translates into the compression of resilient portions 124, 124' respectively against compression surfaces 128, 128'. According to at least one embodiment, one of arm 120 and arm 120' can be urged towards the other by urging a respective handle 136 or handle 136' towards a locked position. According to one embodiment, clamping device 110 is further configured such that each arm (i.e., arm 120 and arm 120') moves a same or an equal distance from a center line A-A' as the other arm whenever arm 120 or arm 120' is moved towards or away from the other arm. According to one embodiment, one of movable blades 114 and 122 can be urged towards each other by urging a respective handle 136 or handle 136' towards centerline A-A' (see FIG. 5).

According to at least one embodiment, surfaces 128, 128' may be pulled away from center line A-A' to cause compression surface 128 and compression surface 128' to move away by a same distance from center line A-A' to define a sewing field on an upper surface of an area of clothing 101. In at least one embodiment, clamping device 110 is configured such that pulling compression surface 128, movable blade 122, arm 120, or handle 136 away from center line A-A' will have the effect of moving compression surface 128', movable blade 122', arm 120', and/or handle 136' by a same distance from center line A-A'. Further, clamping device 110 is configured such that each arm (i.e., arm 120 or arm 120') moves a same or substantially same distance from a center line A-A' as the other arm when arm 120 or arm 120' is moved towards or away from each other.

After this step, arm 120 can be pivoted about arm pivoting point 152 to cause arm 120 to urge movable blade 114 against compression surface 128. Similarly, arm 120' can be pivoted about arm pivoting point 152' to cause arm 120' to thereby urge movable blade 122 against compression surface 128' to thereby retain the tautness of clothing 101. In at least one embodiment, handle 136 and handle 136' are configured for being locked into position after compression of movable blade 114 against compression surface 128 and of movable blade 122 against compression surface 128'. Arm 120 can be locked in place by urging handle 136 to pivot about handle pivoting point 156 to thereby cause arm 120 to be locked in place. Similarly, arm 120' can be locked in place by urging handle 136' to pivot about handle pivoting point 156' to thereby cause arm 120 to be locked in place.

Figure 4:
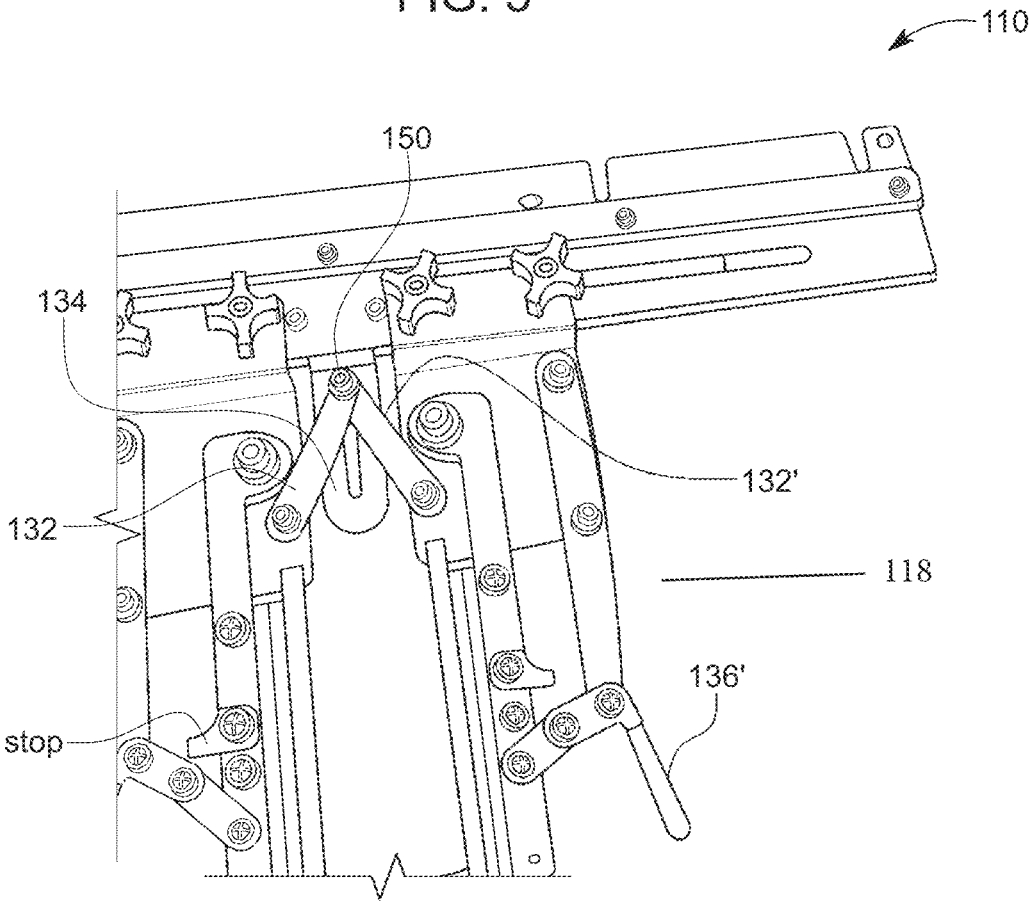
FIG. 4 illustrates a top perspective view of a portion of the clamping device of FIG. 1, according to one or more embodiments of the presently disclosed subject matter.

Accordingly, resilient portions 124, 124' can be moved into engagement with respective compression surfaces 128, 128' by manipulation of handles 136, 136' engaged with respective arms 120, 120', wherein each handle 136, 136' imparts a pivoting, inward movement to each arm 120, 120'. Bracket 132 and bracket 132' are pivotable about central pivot 150 when each one half of the assembly 118 is moved inwardly and outwardly. As illustrated in FIG. 4, for example, bracket 132 and bracket 132' extend from a slot area 134 provided on clamping device 110. Knobs 138 may be provided for tightening purposes for securing clamping device 110 or a component thereof in place.

Figure 5:
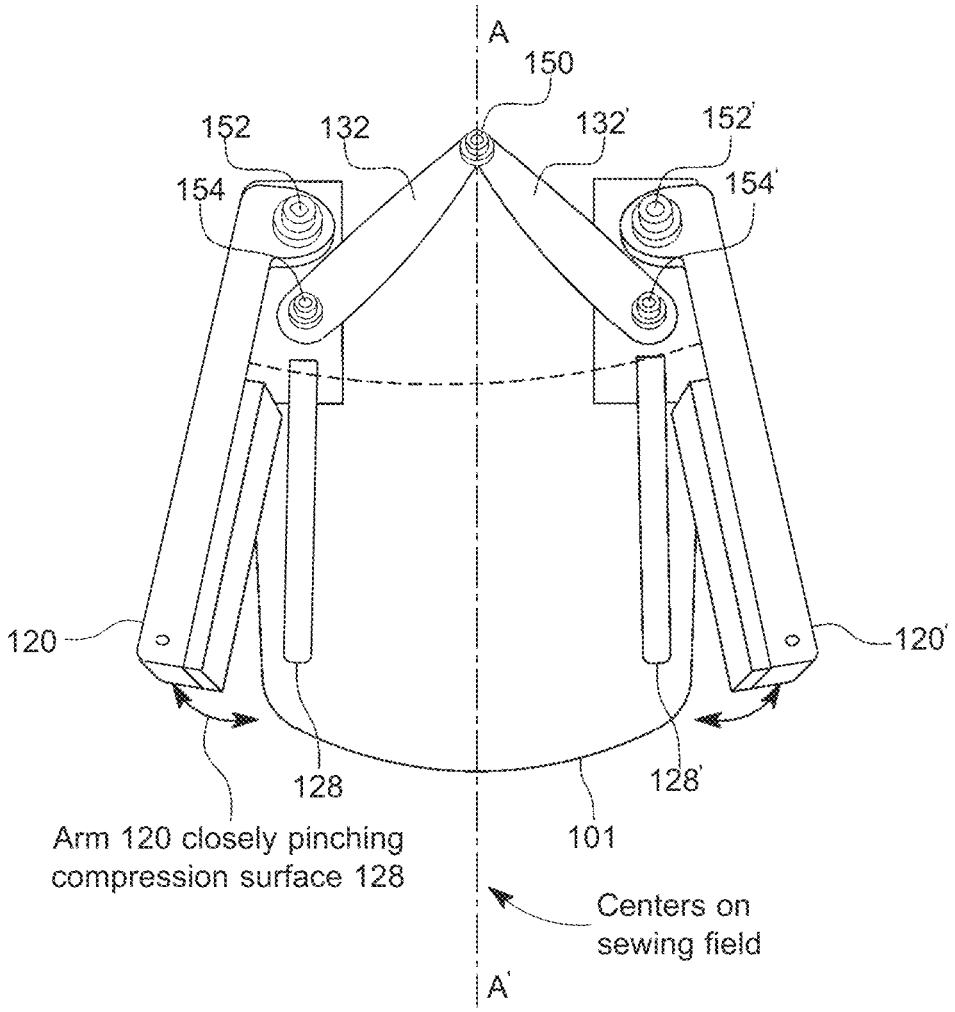
FIG. 5 illustrates a top perspective view of a portion of a clamping device with a fabric tightly engaged in the arms of the clamping device, according to one or more embodiments of the presently disclosed subject matter.

According to one embodiment, during operation, a user inserts compression surface 128 and compression surface 128' into a pocket of a shirt (e.g., clothing 101 in the form of a shirt pocket) as shown, for example, in FIG. 5. After insertion of compression surface 128 and compression surface 128' into clothing 101 in the form of a shirt pocket, the user engages a portion of clothing 101 between the resilient portion 124 and compression surface 128 of arm 120. The user can then pull taut on the clothing 101. In another embodiment, after insertion of compression surface 128 and compression surface 128' into clothing 101 in the form of a shirt pocket, the user can pull taut on the clothing 101 for example after pulling handle 136 or handle 136' away from centerline A-A'. The user can then engage a second portion of clothing 101 between resilient portion 124' and compression surface 128' of arm 120. The user can then optionally lock handle 136 and handle 136' to thereby clamp arm 120 and arm 120' in place to retain an upper surface of clothing 101 in the sewing field. FIG. 5 illustrates a front cross-sectional view of clothing 101 in the form of a shirt pocket being held taut by resilient portions 120 124' pressing against respective compression surfaces 128, 128' while arms 120, 120' are clamped taut in place, for example, by the "locking-in" of handles 136, 136'.

Accordingly, in various embodiments, during operation, the user may engage a first portion of clothing 101 between the resilient portion 124 and compression surface 128 of arm 120, and pull taut on the first portion of an article of clothing 101 and then engage a second portion of clothing 101 between resilient portion 124' and compression surface 128' of arm 120' such that the span of clothing 101 between compression surface 128 and compression surface 128' is held taut such that switching or embroidery work can be carried out in the taut area of clothing 101. In this manner, clamping device 110 can allow for pulling an area of clothing taut (e.g., an upper surface of a shirt pocket) without the use of overly hard surfaces that can otherwise damage or mar the clothing, with the resiliency of resilient portions 124, 124' providing some dampening forces to vibrations imparted by the embroidery, sewing, or other textile working machine. In operation, the resilient portions 124, 124' may deflect outwardly and downwardly when in contact with respective first and second compression surfaces 128, 128'-thus imparting outwardly and downwardly forces illustrated by arrows 157, 157' an area of clothing 101 as illustrated with arrows 157, 157' in FIG. 3.

After upper surface of clothing 101 is held taut in place in the manner illustrated in FIG. 5, the user can perform embroidery work or stitching work on the upper surface of clothing 101 that is held taut in place. By using clamping device 110 in this manner, a portion of clothing 101 can pulled taut and clamped in place to facilitate proper stitching or embroidering on a surface of clothing 101 using a conventional sewing, embroidering or other textile working machines. Use of clamping device 110 can accordingly advantageously prevent the use of overly hard surfaces that can damage the clothing. Further, the resiliency of resilient portions 124, 124' of arms 120, 120' can advantageously supply or provide some dampening forces to dampen any vibrations imparted by an embroidery, sewing, or other textile working machine. In operation, the resilient portions 124, 124' deflect outwardly and downwardly when in contact with respective compression surfaces 128, 128', thus imparting outwardly and downwardly forces to the article of clothing as illustrated with arrows 157, 157' in FIG. 3.

In one or more embodiments, one or more actuators may be provided to mechanically, pneumatically, or electrically actuate any of the movement-related components of the disclosure herein. For example, an actuator could manipulate components 132 and 132' to cause axial movement of surfaces 128, 128'. Alternatively, an actuator could provide pivoting movement to surfaces 128, 128'.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

In light of the above, it will be appreciated that embodiments of the presently disclosed subject matter advantageously provides an improved embroidering equipment which allows embroidering to be efficiently performed. Moreover, embodiments of the presently disclosed subject matter advantageously prevent or reduce unintended embroidering patterns being formed when stitching or embroidering patterns on fabrics and other materials.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced items. Although any methods, devices, and materials similar or equivalent to those described herein can be used in the practice or testing of the presently disclosed subject matter, representative methods, devices, and materials are now described.

In the drawings and specification, there have been disclosed typical preferred embodiments of the inventive subject matter and, although specific terms are employed, they are used in a generic and descriptive sense only and not for purposes of limitation, the scope of the inventive subject matter being set forth in the following claims.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A textile machine clamping device comprising:

a first arm comprising a moveable blade that moves inwardly relative to a first compression surface in response to receipt of translation forces to the first arm, wherein the translation forces are imparted in response to movement of the first arm, wherein the imparted translation is towards a center of the textile machine clamping device;

a second arm comprising a moveable blade that moves inwardly relative to a second compression surface in response to receipt of translation forces to the second arm wherein the translation forces are imparted in response to movement of the second arm, wherein the imparted translation is towards a center of the textile machine clamping device, wherein each of the moveable blades compresses against an article of clothing positioned between each of the first arm and the second arm, wherein, a direction of travel of each of the first arm and the second arm is being translated into a compressed state is towards each other.

2. The textile machine clamping device of claim 1, wherein each arm is movable along a longitudinal direction of an embroidering or sewing machine, wherein each arm is received within a slot that is defined longitudinally along a length of the textile machine clamping device.

3. The textile machine clamping device of claim 2, wherein each arm moves a same distance from a center line that is defined extending through a center of the textile machine clamping device as the other arm.

4. The textile machine clamping device of claim 1, wherein each of the moveable blades defines a resilient portion that compresses against an article of clothing positioned between a respective resilient portion and compression surface of each of the first arm and the second arm, wherein the resilient portion is moved into engagement with the compression surface by manipulation of respective first and second handles engaged with first and second arms, wherein the handles impart a pivoting, inward movement to the arms.

5. The textile machine clamping device of claim 1, wherein the arms slide along a rail, the rail defining graduation marks to determine distance.

6. The textile machine clamping device of claim 4, wherein, in operation, the resilient portions deflect outwardly and downwardly when in contact with an article of clothing held by respective first and second compression surfaces, thus imparting outwardly and downwardly forces to the article of clothing.

* * * * *